US005536992A

United States Patent [19]

Crompton

[11] Patent Number: 5,536,992

[45] Date of Patent: Jul. 16, 1996

[54] LINEAR ELECTRON BEAM TUBES ARRANGEMENTS

[75] Inventor: Timothy A. Crompton, Essex, United Kingdom

[73] Assignee: EEV Limited, Chelmsford

[21] Appl. No.: 553,158

[22] Filed: Nov. 7, 1995

Related U.S. Application Data

[63] Continuation of Ser. No. 266,289, Jun. 24, 1994, abandoned.

[30] Foreign Application Priority Data

Nov. 8, 1993 [GB] United Kingdom ..... 9322934

[51] Int. Cl.[6] ..... H01J 25/20; H01P 7/06

[52] U.S. Cl. ..... 313/293; 313/308; 315/4; 315/5; 315/5.37; 330/44; 330/45

[58] Field of Search ..... 313/293, 306, 313/307, 308, 447; 315/4, 5, 5.37; 330/44, 45

[56] References Cited

U.S. PATENT DOCUMENTS

| | | | |
|---|---|---|---|
| 4,527,091 | 7/1985 | Preist | 315/5.37 X |
| 5,239,272 | 8/1993 | Bohlen et al. | 330/45 |
| 5,317,233 | 5/1994 | Lien et al. | 313/293 X |

FOREIGN PATENT DOCUMENTS

| | | |
|---|---|---|
| 2076723 | 10/1971 | France . |
| 4107552A1 | 9/1991 | Germany . |
| 1344385 | 1/1974 | United Kingdom . |
| 2244173 | 11/1991 | United Kingdom . |
| 2243943 | 11/1991 | United Kingdom . |

*Primary Examiner*—Sandra L. O'Shea
*Assistant Examiner*—Ashok Patel
*Attorney, Agent, or Firm*—Donald C. Casey

[57] ABSTRACT

An inductive output tetrode includes a cylindrical ceramic envelope within which is located an electron gun including a cathode and grid. An annular resonant input cavity into which a high frequency signal is coupled surrounds the envelope and is located adjacent the electron gun so as to provide a modulating electric field in the cathode-grid region to density modulate the electron beam. The input cavity is connected to two metal cylinders arranged immediately adjacent to the outside of the envelope. Metallic portions located within the envelope are co-extensive with cylinders with the material of the envelope 1 being located between them. These structures act as r.f. chokes to reduce high frequency losses from the input cavity. Tuning of the resonant cavity may be achieved by adjusting a tuning member which is at distance of quarter of a wavelength at the resonant frequency from the cathode-grid region.

14 Claims, 3 Drawing Sheets

LINEAR ELECTRON BEAM TUBES ARRANGEMENTS

FIELD OF THE INVENTION

This application is a continuation of application Ser. No. 08/266,289 filed Jun. 24, 1994 now abandoned.

This invention relates to linear electron beam tube arrangements and more particularly to inductive output tetrodes.

BACKGROUND OF THE INVENTION

An inductive output tetrode is an arrangement in which a high frequency input signal is applied via a resonant input cavity to the region between the cathode and grid of an electron gun. This produces modulation of the electron beam generated by the electron gun. The resulting density modulated beam is directed to interact with an output resonant cavity from which an amplified high frequency output signal is extracted.

The present invention seeks to provide an improved linear electron beam tube arrangement.

SUMMARY OF THE INVENTION

According to the invention there is provided a linear electron beam tube arrangement comprising: an electron gun including a cathode and a grid contained within a gas tight envelope of dielectric material; a resonant input cavity outside the envelope arranged such that a high frequency signal applied thereto results in a modulating electric field between the cathode and grid; and choke means arranged to reduce leakage of high frequency energy from the cavity comprising metallic co-extensive portions between which is located part of the envelope. The co-extensive portions may be of substantially the same length, but one portion may be of greater overall longitudinal extent than that with which it is co-extensive.

By employing the invention, a particularly compact arrangement is possible as the envelope material itself forms part of the choke means, resulting in a relatively small overall diameter. Thus, losses of high frequency energy may be reduced without the need for completely discrete choke components and the additional volume that these would require for their accommodation. The reduced diameter of a tube arrangement in accordance with the invention is advantageous as it facilitates handling and installation of the arrangement.

Tuning of resonant cavities is typically accomplished by including a moveable tuning member within the cavity which is spaced from the cathode-grid region by an integral odd number of one quarter wavelengths of the resonant frequency. The tuning member is usually located at a distance of three quarters of the wavelength or five quarters of the wavelengths. The reduced diameter of the envelope also has the advantage that tuning of the resonant frequency of the cavity may be implemented by locating a movable tuning member one quarter of a wavelength at the resonant frequency from the cathode-grid region. Hence not only is the diameter of the envelope reduced, but also the input resonant cavity may be made more compact compared to known arrangements.

Preferably, the envelope is of ceramic material. Such material is capable of holding off some tens of kilovolts across it and is therefore suitable for use in the choke means as well as providing a gas tight envelope.

The metallic portions comprising the choke means may be metal plates which may also act as supports or mounts for other components of the electron gun or to locate and support the input cavity. One or more of the metallic portions may alternatively comprise a layer of metallisation deposited on the envelope. Such a layer need only be as thick as a few times the skin depth at operating frequencies and can be accurately deposited during fabrication of the arrangement.

Preferably, the choke means comprises two pairs of metallic co-extensive portions, one pair being adjacent one wall of the cavity and the other adjacent another of its walls.

BRIEF DESCRIPTION OF THE DRAWINGS

Some ways in which the invention may be performed are now described by way of example with reference to the accompanying drawings in which.

DESCRIPTION OF A PREFERRED EMBODIMENT

Figure 1:
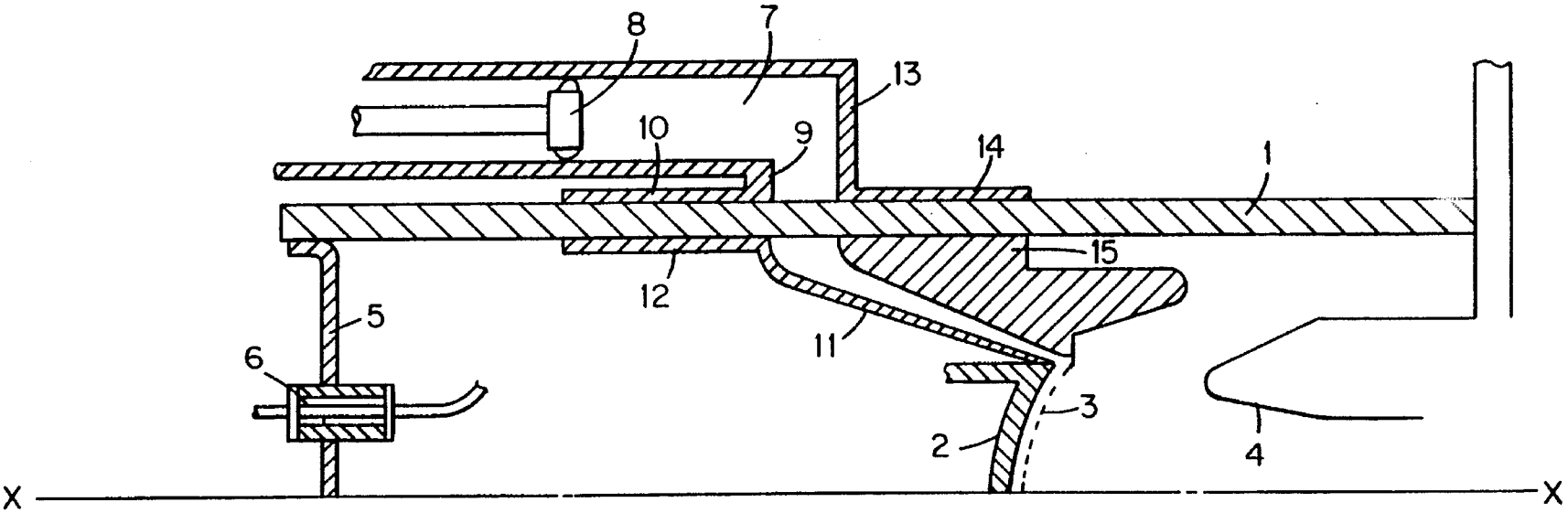
FIG. 1 schematically illustrates in longitudinal section part of an electron beam tube arrangement in accordance with the invention.

With reference to FIG. 1, part of an inductive output tetrode is shown in half section along its longitudinal axis X—X being substantially cylindrically symmetrical. It includes a cylindrical ceramic envelope 1 within which is contained an electron gun comprising a cathode 2, grid 3 and focusing anode 4 spaced apart in the longitudinal direction. The envelope 1 is sealed to an end plate 5 via which electrical connections 6 to components of the electron gun extend, the volume defined by the envelope 1 and end plate 5 being at vacuum.

An input resonant cavity 7, which is substantially annular, is located coaxially outside the envelope 1 and is positioned with respect to the electron gun such that when high frequency energy is applied to the cavity, it results in a modulating electric field being produced in the cathode-grid region. This causes density modulation of an electron beam generated by the electron gun. The cavity 7 includes a tuning member 8 which is movable in a longitudinal direction to adjust the resonant frequency of the cavity 7.

One wall 9 defining the cavity 7 is an annular plate which extends transversely to the longitudinal axis. The wall 9 is integral with a metallic cylinder 10 which is secured to the outer surface of the envelope 1. The cathode 2 is held in position by a support member 11 which includes a cylindrical portion 12 secured to the interior surface of the envelope 1 and co-extensive with the cylinder 10 in the longitudinal direction. The cylinder 10, support member portion 12 and intervening dielectric material of the envelope 1 together define a choke to high frequency energy.

The cavity 7 is further defined by another wall 13 which again is an annular plate transversely extensive with respect to the longitudinal direction and is positioned closer to the anode 4 than the first wall 9. The wall 13 is integral with a metallic cylinder 14 secured to the outer surface of the envelope 1. The grid 3 is supported within the envelope 1 by a cylindrical mount 15 which has an outer surface which is adjacent the interior surface of the envelope 1 and co-extensive with the cylinder 14 in the longitudinal direction. These metal portions 14 and 15 together with the dielectric envelope material located between them form another r.f. choke.

In this arrangement, the distance from the tuning member 8 to the grid-cathode region is approximately one quarter of the wavelength at the resonant frequency.

Figure 2:
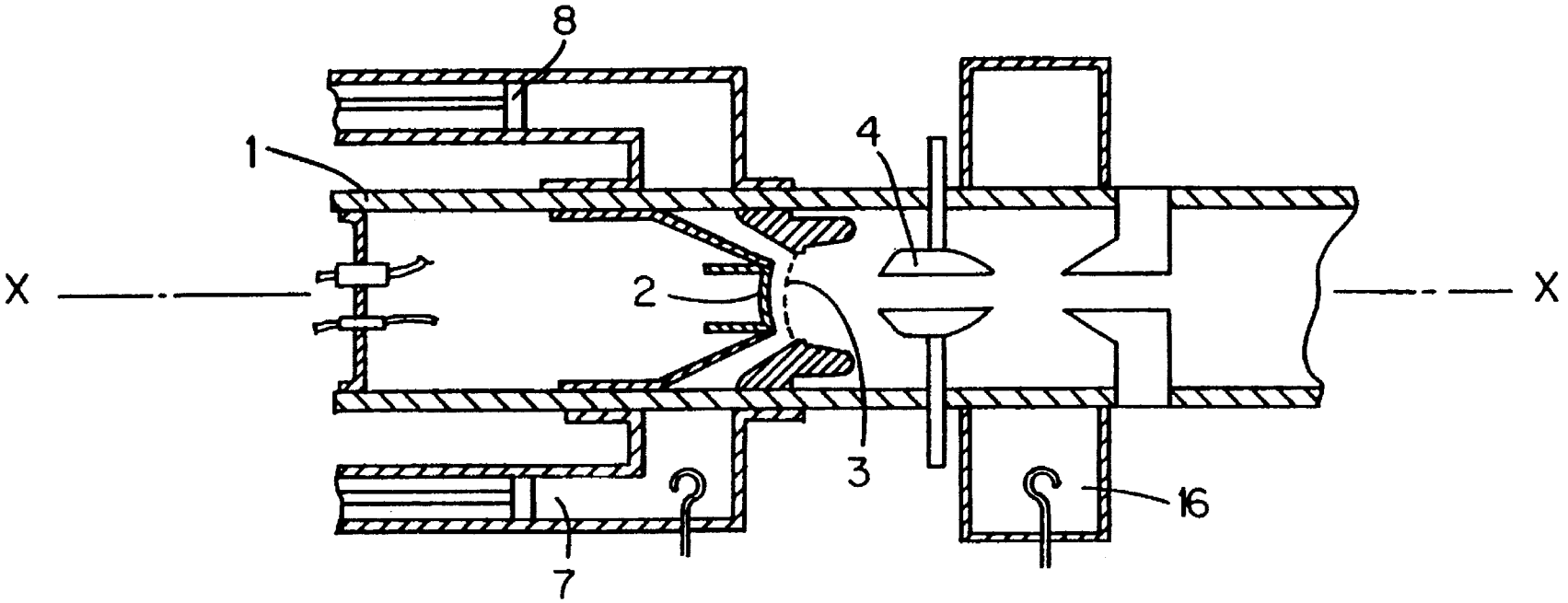
FIG. 2 schematically shows more of the arrangement of FIG. 1.

FIG. 2 shows other parts of the inductive output tetrode, including the output cavity 16.

Although the envelope 1 is illustrated as having a uniform wall thickness along its length, in other arrangements, this may be stepped to present different thicknesses. During assembly, components may then be fitted into the envelope without undue damage and scratching of its interior surfaces.

Figure 3:
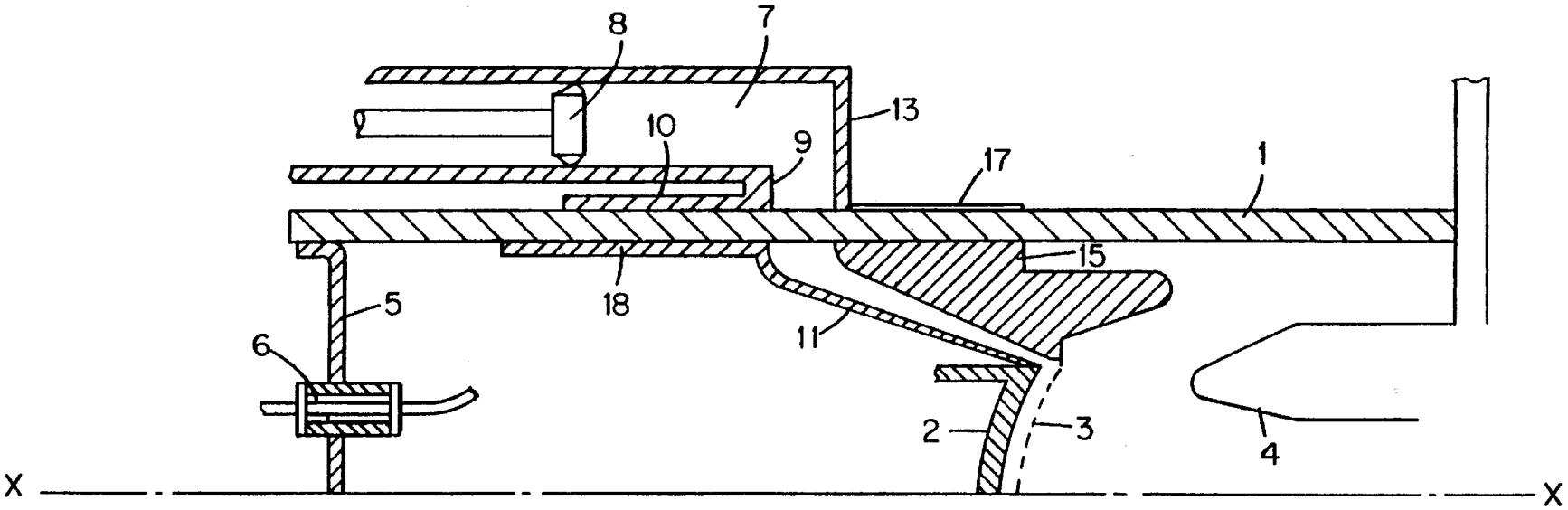
FIG. 3 schematically illustrates part of another arrangement in accordance with the invention.

In another arrangement, shown in FIG. 3, one of the co-extensive metallic members is replaced by a metallisation layer 17 deposited on the envelope surface.

In this embodiment, the metallic portion 18 constituted by part of the cathode support is longer than the corresponding portion 10 on the outer surface of the envelope 1.

I claim:

1. A linear electron beam tube arrangement comprising: an electron gun including a cathode and a grid contained within a gas tight envelope of dielectric material; a resonant input cavity outside and adjacent said envelope arranged such that a high frequency signal applied thereto results in a modulating electric field between said cathode grid; and choke means arranged to reduce leakage of high frequency energy from said cavity, said choke means comprising metallic co-extensive portions between which is located part of said envelope.

2. An arrangement as claimed in claim 1 wherein said envelope is of ceramic material.

3. An arrangement as claimed in claim 1 wherein said cavity is substantially annular and arranged co-axially about said envelope.

4. An arrangement as claimed in claim 1 wherein one of said metallic portions is a metal plate connected to a wall of said cavity.

5. An arrangement as claimed in claim 1 wherein at least one of said metallic portions comprises a layer of metallisation on said envelope.

6. An arrangement as claimed in claim 1 wherein a metallic portion within said envelope is part of a support of an electrode of said electron gun.

7. An arrangement as claimed in claim 1 wherein said metallic portions are substantially cylindrical and coaxial with said envelope.

8. An arrangement as claimed in claim 1 wherein said choke means comprises two pairs of metallic co-extensive portions, one pair being spaced from the other pair in a longitudinal direction.

9. An arrangement as claimed in claim 8 wherein a metallic portion within said envelope is part of a support for an electrode of said electron gun.

10. An arrangement as claimed in claim 8 wherein one pair is adjacent one wall of said cavity and the other pair is adjacent another wall of said cavity.

11. An arrangement as claimed in claim 10 wherein said cavity is substantially annular and includes cavity defining walls normal to the envelope surface, one portion of each said pair being connected to a respective one of said walls.

12. An arrangement as claimed in claim 11 wherein at least one of said metallic portions comprises a layer of metallisation on said envelope.

13. An arrangement as claimed in claim 1 and including a tuning member contained in said input cavity which is adjustable in position to adjust the resonant frequency of said cavity, said tuning member being spaced from said grid by approximately one quarter of the wavelength of the resonance frequency.

14. An inductive output tetrode comprising: an electron gun including a cathode and a grid contained within a gas tight envelope of dielectric material; a resonant input cavity outside and adjacent said envelope arranged such that a high frequency signal applied thereto results in a modulating electric field between said cathode and grid; and choke means arranged to reduce leakage of high frequency energy from said cavity, said choke means comprising metallic co-extensive portions between which is located part of said envelope.

* * * * *

UNITED STATES PATENT AND TRADEMARK OFFICE

CERTIFICATE OF CORRECTION

PATENT NO. : 5,536,992

DATED : July 16, 1996

INVENTOR(S) : Timothy A. CROMPTON

It is certified that error appears in the above-indentified patent and that said Letters Patent is hereby corrected as shown below:

At column 3, line 29, the word "and" has been omitted.

Please insert --and-- between "said cathode" and "grid".

Signed and Sealed this

Nineteenth Day of August, 1997

*Attest:*

*Attesting Officer*

BRUCE LEHMAN

*Commissioner of Patents and Trademarks*